US009872815B2

(12) United States Patent
Rivero

(10) Patent No.: US 9,872,815 B2
(45) Date of Patent: Jan. 23, 2018

(54) RACK AND METHOD FOR FACILITATING MEDICATION-RELATED INFORMATION

(76) Inventor: Maria Lourdes Rivero, Miami, FL (US)

( * ) Notice: Subject to any disclaimer, the term of this patent is extended or adjusted under 35 U.S.C. 154(b) by 0 days.

(21) Appl. No.: 12/715,300

(22) Filed: Mar. 1, 2010

(65) Prior Publication Data

US 2010/0147784 A1 Jun. 17, 2010

Related U.S. Application Data

(63) Continuation-in-part of application No. 11/426,002, filed on Jun. 22, 2006, now abandoned.

(51) Int. Cl.

| | |
|---|---|
| ***A47B 73/00*** | (2006.01) |
| ***A47G 29/00*** | (2006.01) |
| ***A47F 7/00*** | (2006.01) |
| ***A61J 7/04*** | (2006.01) |
| ***A47F 7/28*** | (2006.01) |
| ***G09F 3/02*** | (2006.01) |
| ***G09F 3/00*** | (2006.01) |

(52) U.S. Cl.

CPC ..... *A61J 7/04* (2013.01); *A47B 73/00* (2013.01); *A47F 7/0028* (2013.01); *A47F 7/28* (2013.01); *G09F 3/02* (2013.01); *G09F 3/0288* (2013.01)

(58) Field of Classification Search

CPC .... A47J 47/16; B01L 9/06; B01L 9/54; B01L 9/065; A47B 73/00; A47B 81/007; F17C 13/084; A47F 7/28; A47F 7/0021; A47F 7/0028; A47F 7/0035; A47F 7/283; A61B 19/0256; A61B 19/0271; A61B 2019/0258; A61B 2019/2059; A61B 19/26; B07C 7/02; B25H 3/04; B25H 3/06; B65D 2203/00; B65D 2203/02; B65D 85/20; B65D 5/4204; B65D 83/04; B65D 83/0445; A61J 7/04; A61J 7/00; A61J 7/0069; A61J 7/0076; A61J 7/0084; A61J 7/0092; A61J 9/06; A61J 1/00; A61J 1/16; A61J 1/03

USPC ..... 211/74, 85.18, 85.13, 71.01, 10, 60.1; 40/310, 311, 120; 206/459.5, 446, 305, 206/483, 534, 530, 538, 539; 422/560, 422/562, 566

See application file for complete search history.

(56) References Cited

U.S. PATENT DOCUMENTS 763,128 A * 6/1904 Trumpour ..... 40/310
917,914 A * 4/1909 Van Otteren ..... 248/312
(Continued)

FOREIGN PATENT DOCUMENTS

WO WO2014106735 A1 7/2014

*Primary Examiner* — Jennifer E. Novosad

(57) ABSTRACT

A rack (10) to stock round (26) or semi-round medication containers. The rack (10) has a generally rectangular box shape and includes two side members (16). Both of the two side members (16) include one row of a plurality of generally "C" shaped slots (24) forming a plurality of windows (28). A label (34) with indicia (23) and medication-related information (22) is provided on a face panel (17) of each side member (16). In operation, medication containers (26), including a label (32) with indicia (31) and medication-related information (30), are pegged into the slots (24) of the rack (10) so that the medication-related information (30) of the labels (32) of the medication containers (26) show through windows (28) and align with the corresponding medication-related information (22) of the face panels (17) of rack (10).

20 Claims, 4 Drawing Sheets

(56) References Cited

U.S. PATENT DOCUMENTS 2,048,695 A * 7/1936 Hasenour ..... 206/459.5
3,186,556 A * 6/1965 Forsstrom ..... B01L 9/06 211/74
3,300,055 A * 1/1967 Rohr ..... A47B 81/007 116/307
3,921,805 A 11/1975 Wawracz
D252,429 S * 7/1979 Morin ..... D6/569
4,411,868 A * 10/1983 Noack ..... 422/562
D282,206 S * 1/1986 Roy ..... D24/230
4,640,560 A 2/1987 Blum
4,693,371 A 9/1987 Malpass
4,749,085 A * 6/1988 Denney ..... 206/534
4,793,492 A * 12/1988 Halbich ..... A45C 11/24 206/538
4,819,815 A * 4/1989 Tarlow et al. ..... 211/74
4,889,237 A * 12/1989 Brandon ..... A61J 7/04 206/459.5
4,905,388 A * 3/1990 Sinkow ..... G09F 3/00 283/900
4,951,596 A * 8/1990 Wallace, Jr. ..... G09F 3/16 116/308
D310,848 S * 9/1990 Perbix ..... D20/18
4,976,351 A 11/1990 Mangini
5,024,705 A * 6/1991 Cahill ..... 134/38
5,378,433 A * 1/1995 Duckett ..... B01L 9/06 206/443
5,396,997 A * 3/1995 Johnson ..... 211/59.2
5,415,277 A * 5/1995 Berntsen ..... B65D 21/0212 206/144
5,589,137 A * 12/1996 Markin et al. ..... 422/562
5,615,780 A * 4/1997 Nimetz ..... A47B 77/16 211/120
5,700,429 A * 12/1997 Buhler et al. ..... 422/560
5,921,394 A 6/1999 Shroff
5,941,394 A * 8/1999 Siegler ..... 206/571
6,142,316 A * 11/2000 Harbour et al. ..... 211/59.2
6,464,506 B1 * 10/2002 Welles ..... 434/238
6,478,167 B1 * 11/2002 Burgess ..... 211/59.2
6,652,047 B1 * 11/2003 Maguire, Jr. ..... 312/209
D484,989 S * 1/2004 Gebrian ..... D24/230
6,860,390 B2 * 3/2005 Bowman ..... 206/534
7,228,970 B2 * 6/2007 Holmberg ..... 206/534
7,282,182 B2 * 10/2007 Dale ..... B01L 9/06 422/562
7,988,933 B2 * 8/2011 Vijay et al. ..... 422/404
8,034,305 B2 * 10/2011 LaFleur ..... G01N 35/025 211/74
2003/0044323 A1 * 3/2003 Diamond ..... B01L 9/06 422/562
2006/0037921 A1 * 2/2006 Weigel ..... A47J 47/16 211/74
2007/0295635 A1 * 12/2007 Rivero ..... G09F 3/20 206/538
2009/0010575 A1 1/2009 Sanka
2011/0315568 A1 12/2011 Josep

* cited by examiner

RACK AND METHOD FOR FACILITATING MEDICATION-RELATED INFORMATION

RELATED U.S. APPLICATION DATA

This application is a continuation-in-part of co-pending application Ser. No. 11/426,002, filed on Jun. 22, 2006, entitled APPARATUS AND METHOD FOR FACILITATING MEDICATION-RELATED INFORMATION, and naming Maria Lourdes Rivero as inventor.

COPYRIGHT NOTICE

A portion of the disclosure of this patent document contains material which is subject to copyright protection. The copyright owner has no objection to the facsimile reproduction by anyone of the patent document or the patent disclosure, as it appears in patent files or records, but otherwise reserves all copyright rights whatsoever.

BACKGROUND

Field of Invention

This invention relates to the healthcare field, specifically to a rack and method for the purpose of facilitating a user's ability to assimilate medication-related information.

Description of Prior Art

Often times, users of medications struggle with the issue of understanding how to take them properly. The elderly and those with low literacy, for example, can have problems assimilating the medication-related information that is included on medication labels. Therefore, a user may err in the process of consuming a medication, for example, by taking an incorrect dose of medication, or taking it at the incorrect time of day.

Any such errors, or combination thereof, can cause serious health consequences for users. Accordingly, various inventions have been developed to attempt to address the issue of proper medication consumption.

It is well known that conventional pill boxes are available in various shapes and forms, through many drug stores. Additionally, modified pill boxes can provide an incremental degree of benefit.

U.S. Pat. No. 4,693,371 to Malpass shows a pill box with an inner cover and fill cavity for each type of medication, and time of day. In preparing the device for use, a pharmacist or other person will open the inner cover and fill each cavity with an example of the appropriate dosage of medication corresponding to the time of day during which the medication should be taken. Thus, at the start of each day, the patient or other person will pull the appropriate dose of daily medication out of conventional medication containers, and place it in corresponding cavities to match the example within the inner cover of Malpass' pill box. Although Malpass' invention reduces the possibility of error in the case of certain consistent medications, errors are still possible because, depending on the manufacturer, the same medication may come in different shapes, colors, and sizes, particularly when dealing with generic prescription medications.

U.S. Pat. No. 4,976,351 to Mangini shows a kit for distributing pharmaceutical products, including a tray of drug containers. The printed matter of Mangini is expressed in conventional pharmacy format: "TAKE ONE TABLET FOUR TIMES A DAY UNTIL ALL TAKEN". Particularly looking at the section of Mangini's printed matter which is related to dosing time frames, the term "FOUR TIMES A DAY" can be very confusing to users of medications, assuming that Mangini's invention were to be employed by a user instead of a person or entity distributing pharmaceutical products. Moreover, Mangini's invention does nothing to organize medications by dosing time frames. Accordingly, the art taught by Mangini does not facilitate the user's ability to view medication-related information.

In general, there are significant disadvantages associated with currently available pill box art. The user of a currently available pill box may be incapable of properly navigating the medication labels on conventional medication containers in order to match the information on the labels to the information on the pill box. Thus, the user may be unable to stock the pill box properly. In those cases, a pharmacist or other person must undertake the laborious, and therefore relatively inefficient, process of stocking the medications into the numerous compartments that most pillboxes have in common. Confusion and errors during the process of filling conventional pill boxes can lead to potentially serious consequences for patients. Importantly, it is well known that when patients are confused about medications, or when patients experience side effects due to errors related to their medication intake, they are less likely to be compliant.

Conventional medication charts, which list the user's medications as well as medication instructions, help to clarify what medications to take and what medications not to take, but are too abstract for certain users, such as the elderly and those with low literacy. Moreover, a medication chart does nothing to organize the various medication containers that a user may be employing.

Electronic apparatuses of various structures and functions have been developed to address the issue of proper medication consumption. However, these apparatuses are relatively costly and necessitate maintenance.

OBJECTS AND ADVANTAGES

Accordingly, the objects and advantages of the present invention are:

(a) to provide a rack and method which will facilitate—in other words, help—a user's ability to assimilate medication-related information imprinted on round, or semi-round, medication containers, without the relatively high level of labor that is necessitated to stock conventional pillboxes, and (b) to provide a rack and method which will facilitate a user's ability to assimilate medication-related information, without the possibility of confusion and consequential errors that are associated with filling currently available pill boxes, and (c) to provide a rack and method which will facilitate a user's ability to assimilate medication-related information, at a reasonable level of cost, and (d) to provide a rack and method which will facilitate a user's ability to assimilate medication-related information, without the confusion that is associated with medication charts.

Further objects and advantages will become apparent upon further study of the balance of this application.

SUMMARY OF INVENTION

According to the preferred embodiment, a rack is provided to stock round, or semi-round, medication containers. The rack has a generally rectangular box shape, completely open on one of the four long sides. Said open side faces downwards and comprises the base of the rack, the long side that is parallel to the base comprises a top member of the rack, and the remaining two sides comprise side members. The two side members tilt towards each other; therefore the top member is narrower than the base opening. Two rows of a plurality of generally "C" shaped slots extend downwards from the top member of the rack, each slot in its respective row bisecting one side member to form a plurality of windows on both side members. A label with indicia and medication-related information is provided on a face panel of each side member. In operation, medication containers, including a label with indicia and medication-related information, are pegged into the slots of the rack so that the medication-related information of the labels of the medication containers align with the corresponding medication-related information on the face panels of the side members. Accordingly, a user will be able to observe the medication-related information of the face panel of the rack, and also continuously observe the corresponding medication-related information of a medication container, or of several medication containers. For example, if the user notes, on the medication-related information of the face panel of the rack, the designation MORNING, then the user will be able to continuously view the generally aligned and corresponding medication-related information of one, or more medication containers, to search for the corresponding medication-related information, such as TAKE 1, thereby noting those medications, and quantity thereof, that need be consumed by the user.

DESCRIPTION OF THE INVENTION

Figure 1:
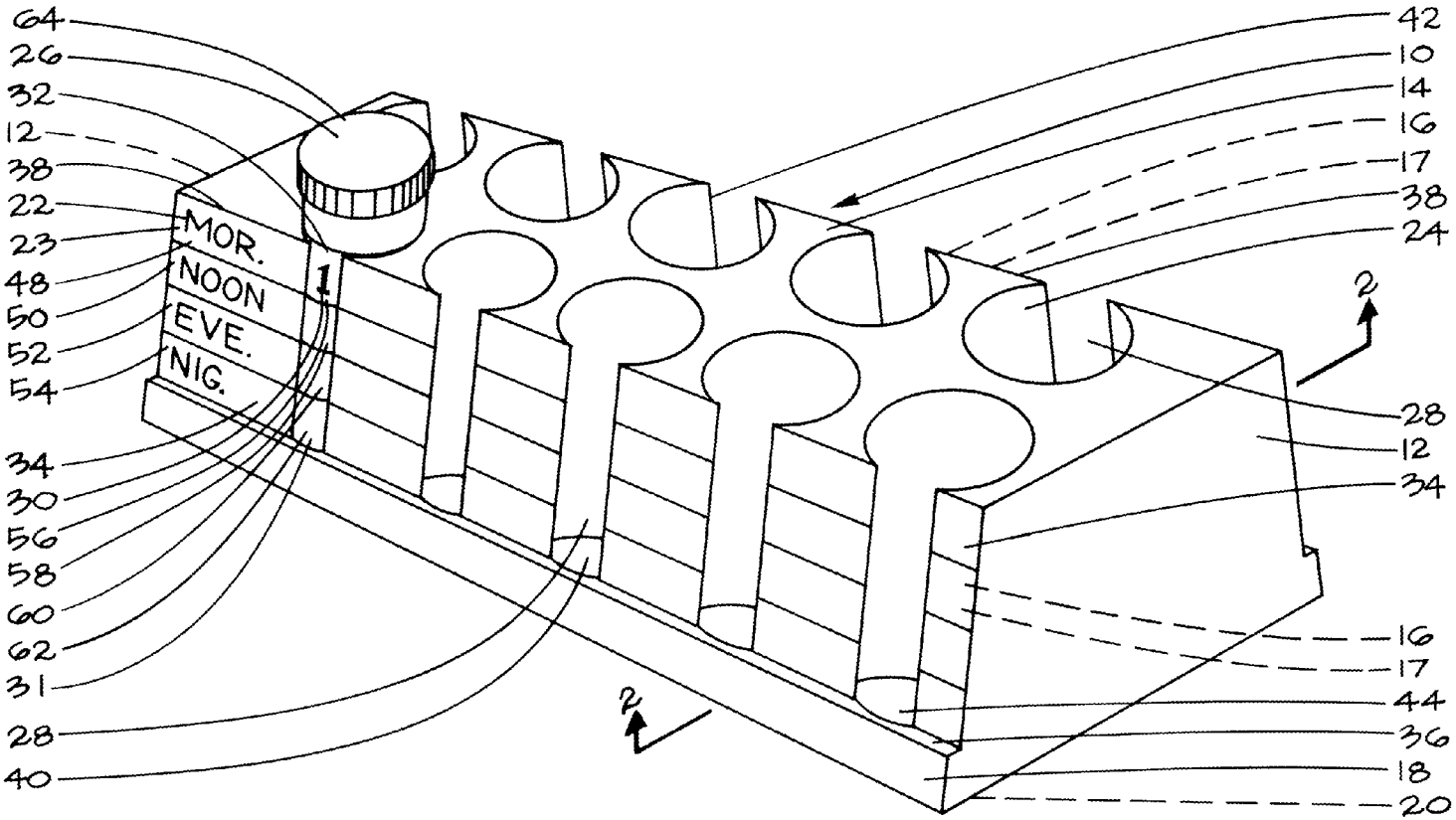
FIG. 1 is an isometric view of the preferred embodiment showing slots with windows, medication-related information of the present invention, and a medication container.
Figure 2:
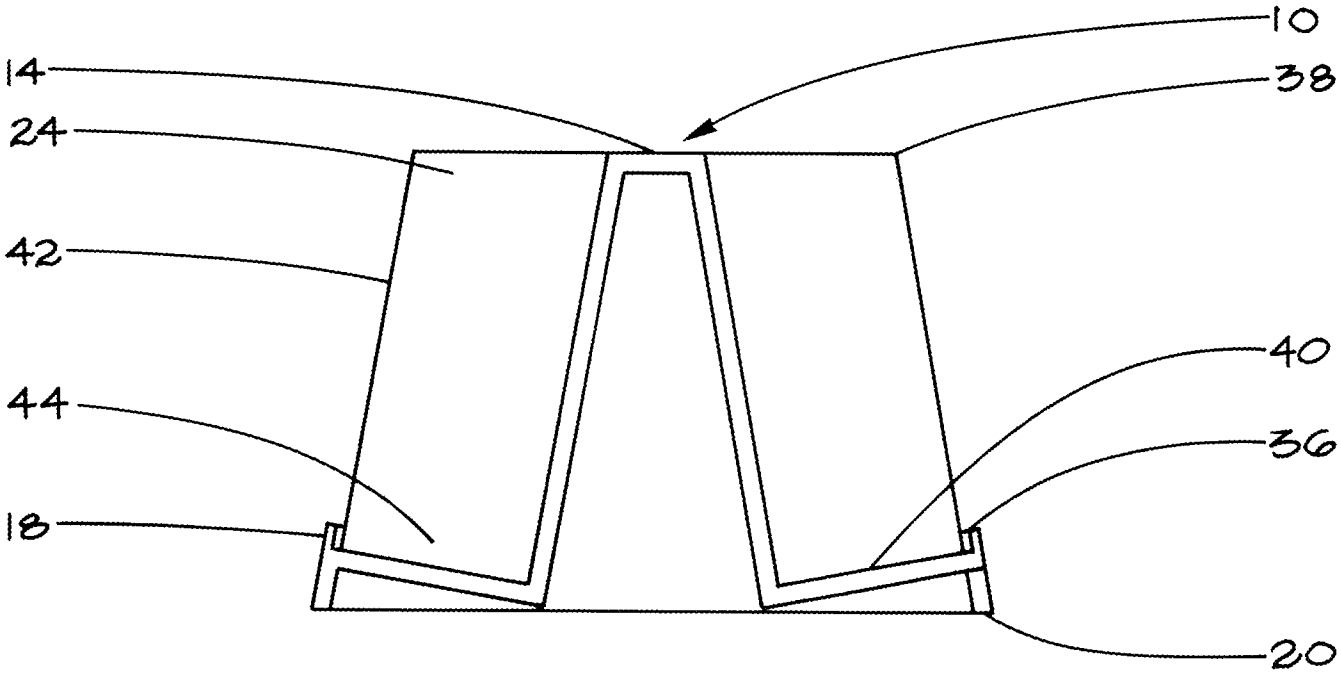
FIG. 2 is a sectional view of the preferred embodiment through a slot.

According to the preferred embodiment, FIGS. 1 and 2 illustrate a rack 10 which has a generally rectangular box shape. Rack 10 includes two equal end members 12 which are perpendicular to an adjoining top member 14. Two equal side members 16 adjoin top 14 and sides 16. Sides 16 are slanted toward each other by about 10 degrees. Sides 16 include a face panel area 17 which covers all of the outside areas of sides 16, except for the area of a lip member 18 which extends the full length of sides 16 and is about 15 mm. high. An integral peripheral edge which is formed by sides 16 and adjoining ends 12 forms a base 20. Rack 10 is intended to accommodate—in other words, accommodate structurally by way of size and shape—medication-related information 22, indicia 23, a row of round circumference, generally "C" shaped slots 24, and windows 28. The length of rack 10 maximizes the number of slots 24, while also preferably enabling medication rack 10 to fit length-wise inside a standard kitchen top-cabinet. Therefore, rack 10 preferably accommodates five mid-size round conventional medication containers 26 per row, plus the space necessitated to accommodate medication-related information 22 and indicia 23. The width of rack 10 accommodates two rows of slots 24. And the height of rack 10 accommodates the height of slots 24. However, rack 10, like all of the racks of present invention, can alternatively be designed to accommodate different size containers, as well as additional, or fewer, containers, depending upon the medicinal needs of a user of medications. Slots 24 are structured—in other words, sized and shaped—to accommodate container 26, and to level medication-related information 30 and indicia 31 of containers 26, with windows 28 and with medication-related information 22 and indicia 23 of a label 34 of rack 10. The spacing between slots 24 is preferably sized in relation to the diameter of the cap of container 26, preferably leaving about 5 mm. of space between container 26 caps. Slots 24 are integral with top 14 and with sides 16. The round circumference of slots 24 pierces sides 16, and slots 24 also slant parallel to sides 16, thus outlining the generally "C" shaped form of slots 24, and forming integral windows 28. In order to accommodate container 26, the diameter of slots 24 is about 2 mm. larger that the diameter of container 26, at the point where the circumference of container 26 meets top 14 (the diameter of container 26 at the point where the circumference of container 26 meets top 14 is approximately 38 mm.). The depth of slots 24 preferably equals the height of container 26, starting from about 10 mm. below the neck of container 26, and reaching a slot bottom member 40. The width of windows 28 preferably matches the width of indicia 31 of container 26 (which is 20 mm.). Accordingly, roughly 17% of the circumference of container 26 is estimated to be exposed through windows 28. The height of windows 28 generally matches the height of medication-related information 30 and indicia 31 of a label 32 of containers 26. The walls of slots 24 taper towards face 17 of sides 16 to form a window peripheral edge 42 that is about 1 mm. in thickness. The round circumference of slots 24 pierce into lip 18, causing a completely round "O" shaped slot pocket 44 which is located towards the bottom of slot 24. The height of slot pockets 44 extends from a top edge 36 of lip 18 to the bottom 40 of slots 24, and matches the distance from the bottom of container 26 to where label 32 is attached to container 26, which is at 5 mm. above the bottom of container 26. In order to facilitate the leveling of indicia 23 and medication-related information 22 of rack 10 with medication-related information 30 and indicia 31 of container 26, all of the lines of rack 10, facing side members 16, are parallel, and windows 28 are perpendicular. Rack 10 is preferably constructed of injection molded plastic, and all of the members of rack 10 preferably have a wall thickness of 3 mm, unless otherwise noted.

Referring again to FIGS. 1 and 2, the reader will note that the printed matter of co-pending application Ser. No. 11/426,002, filed on Jun. 22, 2006, entitled APPARATUS AND METHOD FOR FACILITATING MEDICATION-RELATED INFORMATION is fully incorporated in the current invention. Accordingly, medication-related information 22 and indicia 23 are arranged to generally align and to correspond with indicia 31 and medication-related information 30 of container 26. A label 34, comprised of medication-related information 22 and indicia 23, is accommodated by rack 10, and is attached to the face panel 17 of both sides 16 of rack 10. Label 34 preferably extends the full width of sides 16, and is bisected by windows 28. The height of label 34 preferably extends from the top edge 36 of lip 18, to a top edge 38 of face panel 17. Label 34 is preferably of the conventional self-adhesive, coated paper grade. Medication-related information 22 and indicia 23 are generally level with label 34, and are preferably conventionally imprinted.

Indicia 23 match indicia 31 of container 26. Indicia 23 include four horizontal spaces which are generally arranged vertically, preferably evenly divided within label 34: a space 48, a space 50, a space 52, and a space 54. Indicia 23 also preferably include four different band colors which, again, match the four band colors of container 26. The preferred band colors covering the spaces are: light blue for space 48, yellow for space 50, purplish-orange for space 52, and grey or black for space 54. The specific colors are preferably intended to approximate the natural colors of each time period, for example, grey or black for an evening time period. Medication-related information 22 is contained within the four indicia 23 spaces, including four preferably standard time frames such as: "MORNING" in space 48 (abbreviated on FIG. 1 as "MOR.", for clarity), "NOON" in space 50, "EVENING" in space 52 ("EVE."), and "NIGHT" in space 54 ("NIG."). The typeface and size of the characters that comprise medication-related information 22 matches that of medication-related information 30.

Referring again to FIGS. 1 and 2, container 26 is preferably comprised of a single size round container that is large enough to sustain a 30-day supply of pills, such as a 20 DRAM container, as manufactured by Rexam PLC, of London, UK. Container 26 label 32 is comprised of medication-related information 30 and indicia 31. An additional label containing conventional pharmacy/medication information, as conventionally done, is also preferably attached to container 26, as conventionally done. The height of label 32 is preferably determined by making as much use as possible of the height of container 26, in order to make the medication-related information 30 and indicia 31 as large—and therefore as legible—as possible. The width of label 32 is intended to accommodate indicia 31 and medication-related information 30, and is therefore 20 mm. Indicia 31 and medication-related information 30 are provided on label 32, preferably imprinted, and are generally level with label 32. Label 32 and imprinting related to indicia 31 and medication-related information 30 are preferably of conventional pharmacy grade. The typeface of the characters that comprise medication-related information 30 is preferably the conventional pharmacy standard. The size of the characters is preferably as large as reasonably possible—considering conventional typesetting standards—in order to enhance readability. Accordingly, the width of indicia 31—which is intended to accommodate medication-related information 30—is 20 mm. Label 32 is attached to container 26 at 5 mm. above the bottom of container 26; therefore, medication-related information 22 and indicia 23 of rack 10 will generally level with medication-related information 30 and indicia 31 of container 26. Label 32 of container 26 generally levels with label 34 of rack 10 when medication container 26 is pegged into slot 24. Indicia 31 and medication-related information 30 of medication container 26 are arranged so that they align with the corresponding indicia 31 and medication-related information 30 of any additional medication containers 26 that the user may necessitate for storing additional medications, since all container 26 labels 32 contain the same indicia 31. Indicia 31 include preferably four horizontal spaces which are generally arranged vertically, preferably evenly divided within label 32: a space 56, a space 58, a space 60, and a space 62, and each space is covered by a band of a different color, as described for indicia 23 of rack 10. The four indicia 31 spaces of container 26 include medication-related information 30, which is specific for each medication. For example, as depicted in FIG. 1, if a medication "X" 64 with instructions to be taken one time per day, in the morning, is to be taken by a user, rack 10 medication-related information 22 "MORNING" and indicia 23 of space 48 will correspond and align with container 26 medication-related information 30 "1" and indicia 31 of space 56 of container 26. (For the purpose of the present invention, that medication-related information 22 "MORNING" of rack 10, and medication-related information 30 "1" of container 26 will "align", or "generally align", means that both terms—"MORNING" and "1"—will be generally in line horizontally so that the user will be able to more easily follow and read both terms horizontally across rack 10 and container 26, therefore facilitating the user's ability to assimilate both terms as a united message; that indicia 23 space 48 of rack 10, and indicia 31 space 56 of container 26 will align means that both space 48 and space 56 will be generally in line horizontally, thus to help guide the user to be able to more easily follow and read medication-related information 22 "MORNING" and medication-related information 30 "1" across rack 10 and container 26; that medication-related information 22 "MORNING" will "correspond" to medication-related information 30 "1" means that the two terms are synergistically related, in other words, medication-related information 22 "MORNING" conveys that medication "X" 64 is to be consumed at least in the morning, and that "1" one pill of medication "X" 64 is to be consumed at least in the morning; that indicia 23 space 48 of rack 10 will "correspond" to indicia 31 space 56 of container 26 means that both indicia are related by the intended order, in other words, rack 10 includes four spaces that are intended to align with the four spaces which are included in container 26, and because space 48 is the first space of rack 10—from the top down—then space 48 of rack 10 corresponds to the first space of container 26—from the top down—which is space 56. Moreover, the terms "aligned", and "generally aligned", refer to any level of alignment that facilitates an intended objective of the present invention: the user viewing both terms, as described above, horizontally across rack 10 and container 26, and assimilating both terms as a united message). If the same medication "X" 64 is to be consumed only in the morning, in the form of a single pill, then, as stated above, medication-related information 30 of container 26—which contains medication "X"—will include the medication-related information 29 "1" in space 56. Thus, the medication-related information 30 of spaces 58, 60, and 62 of the container 26 containing medication "X" will preferably be blank, since no pills are to be taken during these time frames (alternatively, a number "0", for example, can be imprinted on spaces 58, 60, and 62 to denote that no pill is to be taken). In addition to label 32, container 26 also preferably includes another separate conventional label with conventional pharmacy/medication information, as conventionally done or, alternatively, the conventional pharmacy/medication information can be included on the same label 32, somewhere besides medication-related information 30, within a larger fold-around label.

Figure 3:
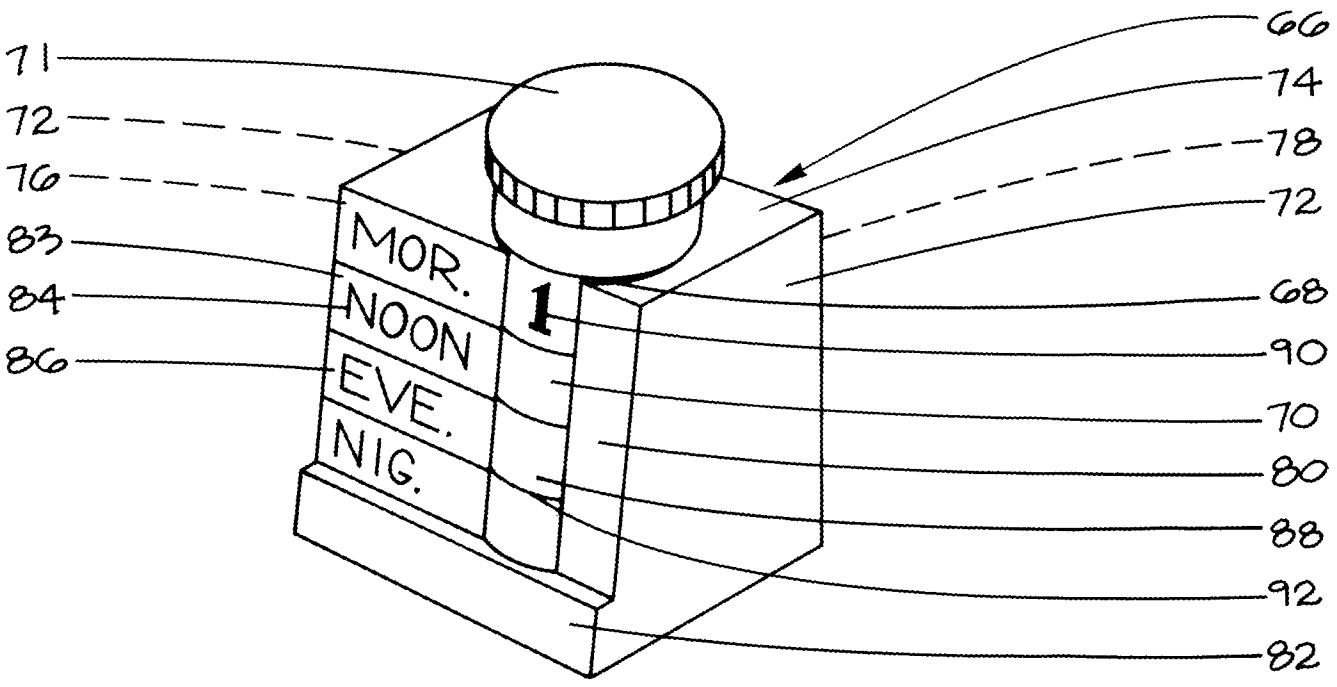
FIG. 3 is an isometric view of an alternative embodiment showing a medication rack with only one semi-round slot, and semi-round container.

FIG. 3 illustrates an alternative embodiment. A medication rack 66 has the same general structure as medication rack 10, with the principal exception that rack 66 has only one slot 68, and one window 70. Slot 68 has the same structure as slot 24 except that slot 68 has a semi-round "C" shaped configuration to accommodate a semi-round shaped medication container 71. Slot 68 is preferably structured to accommodate container 71 so that the widest diameter—or width—of oval container 71 is oriented to face window 70 in order to better accommodate medication-related information 90 and indicia 92. However, slot 68 can alternatively be structured to accommodate oval container 71 in any orientation. Accordingly, slot 68 integrates with window 70 similarly to how slot 24 integrates with window 28. Rack 66 includes two minor equal end members 72 which are perpendicular to an adjoining top member 74. End members 72 also adjoin side members 76 and 78. Side 76 is slanted toward side 78 by about 10 degrees, and adjoins top 74. Side 78 is perpendicular to adjoining top 74. Side 76 includes a face panel area 80 which covers all of the outside areas of side 76, except for the area of a lip member 82 which preferably extends the full length of side 76, and is about 15 mm. high. Window 70 has the same structure as window 28. Rack 66 is preferably constructed of injection molded plastic, and all of the members of rack 66 preferably have a wall thickness of 3 mm, unless otherwise noted.

Referring again to FIG. 3, a label 83 is attached to face panel 80, and is similar to label 34 of rack 10, except that label 83 is smaller because it covers only the portion of side 76 that extends until window 70, and it is for only one medication container. Medication-related information 84 and indicia 86 are also similar to medication-related information 22 and indicia 23 of rack 10, but are not bisected by window 70 because medication-related information 84 and indicia 86 end at window 70. Label 83, including medication-related information 84 and indicia 86, can alternatively be designed to extend across both portions of side 76.

Referring again to FIG. 3, container 71 is comprised of a single size, semi-round shaped container that is large enough to sustain a 30-day supply of pills. A container label 88 is equal to label 32 of container 26. Medication-related information 90 and indicia 92 are equal to indicia 31 and medication-related information 30 of container 26.

Figure 4:
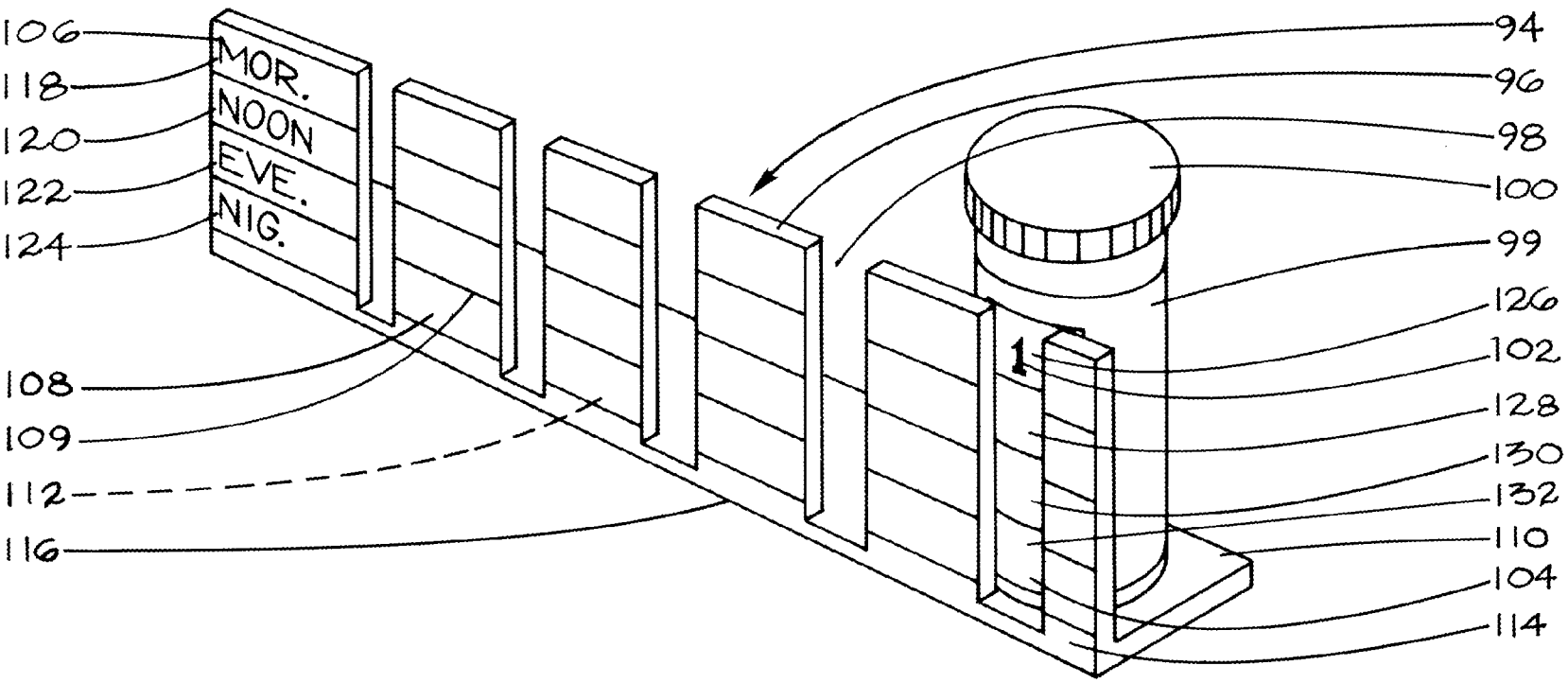
FIG. 4 is an isometric view of an alternative embodiment showing an "L" shaped medication rack with windows, medication-related information of the present invention, and a medication container.

FIG. 4 illustrates another alternative embodiment. A generally "L" shaped medication rack 94 includes a wall panel 96. Wall 96 is preferably a plane solid panel, intended to accommodate windows 98, and to accommodate medication-related information 106 and indicia 108 of rack 94. The height of wall 96 is sized to exceed, by 5 mm, the height of medication-related information 106 and indicia 108. The length of wall 96 accommodates medication-related information 106, indicia 108, and a row of preferably five windows 98. The width of windows 98 is intended to accommodate medication-related information 102 and indicia 104 of containers 100 and is, therefore, about 20 mm. wide. Windows 98 penetrate directly through wall 96, and extend the full height of wall 96. The spacing between windows 98 is preferably sized in relation to the diameter of the cap of container 100, preferably leaving about 5 mm. of space between container caps. Wall 96 is preferably perpendicular to, and rests directly upon, an integral stand 110, which is preferably a plane solid panel, sized to support wall 96 and to act as a platform for accommodating containers 100. Wall 96 includes a face panel area 112 which covers all of the area of wall 96 that faces the opposite of stand 110. Rack 94 is constructed of injection molded plastic, and all of the members of rack 94 preferably have a wall thickness of 5 mm.

Referring again to FIG. 4, medication-related information 106 and indicia 108 are preferably silk-screened directly onto wall 96, and are bisected by windows 98. Medication-related information 106 and indicia 108 are arranged to generally align and to correspond with indicia 104 and medication-related information 102 of container 100. Accordingly, medication-related information 106 and indicia 108 cover all of face panel 112 of wall 96, except for an area 114. Area 114 is rectangular in shape and extends from a bottom periphery 116 of rack 94 to 10 mm. in height. Except for the colors, indicia 108 is similar to indicia 23, and includes preferably four horizontal spaces which are arranged vertically, preferably evenly divided: a space 118, a space 120, a space 122, and a space 124. Indicia 108 are comprised of clear white space and black lines 109 which denote and separate spaces 118, 120, 122, and 124. Medication-related information 106 is equal to medication-related information 22, and is contained within the four indicia 108 spaces, including: "MORNING" in space 118 (abbreviated on FIG. 4 as "MOR.", for clarity), "NOON" in space 120, "EVENING" in space 122 ("EVE."), and "NIGHT" in space 124 ("NIG.").

Referring again to FIG. 4, container 100 is equal to container 26. A label 99 of container 100 is similar to label 32, except that label 100 is about 5 mm. taller, and label 100 includes both medication-related information 102 and indicia 104, and conventional pharmacy/medication information. Indicia 104 and medication-related information 102 of container 100 are similar to indicia 31 and medication-related information 30 of container 26, except that indicia 104 and medication-related information 102 are about 10 mm. wider than window 98. Medication-related information 102 and indicia 104 are aligned with the bottom of label 99, and label 99 is attached to container 100 at 5 mm. above the bottom of container 100.

OPERATION OF THE INVENTION

According to the preferred embodiment, as depicted in FIGS. 1 and 2, the manner of using the present invention includes filling container 26 with a medication, or medications. Medication container 26 may be filled with medication and labeled with indicia 31 and medication-related information 30 by a pharmacist or other person at a retail location, such as a pharmacy, as conventionally done. Medication container 26 may alternatively be filled with medication and labeled at any other point of distribution, such as at a medication manufacturer's facilities, also as conventionally done. In the case of the manufacturer's facilities, the manufacturing process will fill the container. The manufacturer will also generate and place general medication information on a label, and attach that label to medication container 26. Subsequently, a pharmacist or other person at a retail location, or similar, will generate and attach label 32, including indicia 31 and medication-related information 30, to container 26. Since indicia 31 and medication-related information 30 can be portrayed on container 26 at any point throughout the various distribution channels of medications, label 32 can be attached to container 26 by a manufacturer, with the medication-related information 30 of spaces 56, 58, 60, and 62 blank. Subsequently, the pharmacist or other person can add additional medication-related information 30 to container 26, such as "TAKE 1", based on the particular needs of a given user. The additional medication-related information 30 can be added in the form of a small sticker, for example. In the case of OTC medications, the user, or other person, may add the additional medication-related information 30 to label 32 by handwriting it in, for example. Label 32 will be positioned on container 26 at about 5 mm. above the bottom of container 26, for ease of label application, and label 32 will extend to about 10 mm. below the neck of container 26, also for ease of label application. In order to facilitate the leveling of medication-related information 30 and indicia 31, of label 32 of container 26, with the medication-related information 22 and indicia 23 of label 34, of rack 10, label 32 should be attached to container 26 as parallel to the bottom of container 26 as reasonably possible. Accordingly, label 32 of container 26 will also be generally level with the label 32 of any additional containers 26 that the user may necessitate for any additional medication needs. In the case wherein the pharmacist or other person fills the medication container 26, the pharmacist or other person will preferably generate and place label 32 on medication container 26 in the same manner, and preferably also generate and attach another separate conventional label with conventional pharmacy/general medication information, as conventionally done. In accordance with the above, any additional medication containers 26 that need to be filled with medications, in order to accommodate any additional medication needs of the user, will also be filled and labeled.

In reference to medication rack 10, as depicted in FIGS. 1 and 2, a person will position and arrange medication-related information 22 and indicia 23 of rack 10 so that they generally align and correspond with indicia 31 and medication-related information 30 of label 32 of container 26. Since top edge 36 of lip 18 is 5 mm. above bottom 40 of slot pocket 44, label 34 will be attached to face panel 17 adjacent to edge 36. Label 34, including indicia 23 and medication-related information 22, is preferably attached to face panel 17 of rack 10, by the manufacturer of medication rack 10. Alternatively, a pharmacist or other person will attach label 34 to rack 10. The person attaching label 34 to rack 10 may choose to attach label 34 to only one of the two face panels 17. And in situations wherein the user is consuming more medications than the number of containers 26 that can be pegged into one single row of slots 24, label 34 will be attached to both face panels 17, so that both rows of slots 24 can be employed. The pharmacist or other person will then preferably peg medication containers 26 into slots 24 of medication rack 10, preferably in the process also rotating containers 26, as needed, so that the indicia 31 and medication-related information 30 are aligned for viewing through windows 28. Thus, indicia 31 and medication-related information 30 of medication container 26 will be generally level with the corresponding and generally aligned indicia 23 and medication-related information 22 of label 34 of rack 10, and indicia 31 and medication-related information 30 of medical container 26 will also be generally level with the corresponding and generally aligned indicia 31 and medication-related information 30 of any additional medication containers 26—resulting from the user's need for consuming a plurality of medications—that are pegged into slots 24. Because window 28 has a width of 20 mm, and slot 24 has a diameter of approximately 40 mm.—to accommodate container 26, which has a diameter of approximately 38 mm.—the resulting "C" shaped configuration of slots 24 will enable the medication-related information 22 and indicia 23 of rack 10 to partially embrace containers 26—when containers 26 are pegged into slots 24. In other words, the combination of windows 28, the "C" shaped configuration of slots 24, and the tapered ends of slots 24—which lead to peripheral edge 42—will enable the medication-related information 22 and indicia 23 of rack 10 to partially embrace the medication-related information 30 and indicia 31 of container 26. This configuration will enhance the user's ability to view horizontally the medication-related information 22 of rack 10, and also view the generally aligned and corresponding medication-related information 30 of medication container 26, as well as the generally aligned and corresponding medication-related information 30 of any additional medication containers 26 that are also pegged into slots 24. The slant of sides 16 makes it easier for the user to view the medication-related information 22 of rack 10, and the medication-related information 30 of medication container 26. Since rack 10 is preferably sized to fit into a standard kitchen-top cabinet, the user will have the option of storing rack 10 accordingly. The twin row configuration of rack 10 facilitates handling, and enables efficient accommodation of windows 28.

Another advantage of rack 10, as depicted in FIGS. 1 and 2, is that lip 18 and pocket 44 cover the portion of container 26 that excludes medication-related information 30 and indicia 31 of label 32. Therefore, medication-related information 30 and indicia 31 of container 26 is more isolated and, accordingly, clearer for the user to view and assimilate. All of the racks of the present invention—wherein a lip member is included—share this advantage.

Thus, the user of the preferred embodiment, as depicted in FIGS. 1 and 2, will preferably first look vertically at the vertically arranged medication-related information 22 of one of the two face panels 17, of one of the two sides of rack 10, noting and choosing the time frame for which he/she will consume his/her medication or medications. The user will then be able to view continuously, horizontally, and from left to right, medication-related information 22 of one face panel 17, and also the generally aligned and corresponding medication-related information 30 of medication container 26, as well as the generally aligned and corresponding medication-related information 30 of any additional medication containers 26 that are also pegged into slots 24. Rack 10 indicia 23 and container indicia 31 will help guide the user through the process. The user will be able to repeat the same steps on the other side of rack 10, if there are containers 26 pegged on that side. For example, if a user is to consume his/her morning medication or medications, the user will observe the "MORNING" space 48 of medication-related information 22 of rack 10. Then the user will be able to continuously view the generally aligned medication-related information 30 on space 56 of label 34 of all of his/her medication containers 26, to specifically select those medications that should be consumed in the morning, also noting the quantity of medication that is to be taken. Accordingly, if the user notes in space 56 of medication-related information 30 of medication "X" 64 contained in one medication container 26, the designation "1", then the user will know to take one dose of that particular medication as part of his/her morning consumption of medication, because space 56 is generally aligned and corresponds with space 48 medication-related information 22 "MORNING" of rack 10. The user will be able to do the same for his/her noon medications, evening medications, and night medications. After the user withdraws a specific individual container 26 from rack 10 and consumes the respective medication, the user will then replace the specific container 26 back into slot 24 of rack 10, preferably returning the specific container 24 into the same slot 24 from which it was removed, as a matter of organization and convenience. Accordingly, the user's ability to assimilate the medication-related information of the present invention will be facilitated. Therefore, the user will be able to take his/her medications without the confusion that is associated with filling conventional pill boxes, or employing medication charts. The present invention also eliminates the cost associated with complex electronic dosing apparatuses.

FIG. 3 illustrates an alternative embodiment. The operation of rack 66 is similar to the operation of rack 10, with the exception that rack 66 accommodates only one semi-round shaped container 71. Container 71 is filled with medication in the same manner as container 26. Label 88 is attached to container 71 in a manner which is similar to how label 32 is attached to container 26, and conventional pharmacy/general medication information is also attached to container 71 in a manner which is similar to how it is attached to container 26. Because container 71 is oval, the pharmacist or other person will need to perform the additional function of adjusting and aligning label 83 on container 71 so that medication-related information 90 and indicia 92 will become visible through window 70 when container 71 is pegged into slot 68. The conventional pharmacy/general medication information label will also have to be adjusted accordingly—considering where label 88 is attached—within semi-round container 71.

Referring again to FIG. 3, label 83 of rack 66, including indicia 86 and medication-related information 84, is attached to face panel 80 in a manner that is similar to how label 34 is attached to rack 10. And the pharmacist or other person also preferably pegs medication container 71 into slot 68 of medication rack 66. Thus, indicia 92 and medication-related information 90 will be visible through window 70. The user of rack 66 will employ rack 66 similarly to how rack 10 is employed. However, if the user has a plurality of medication containers 71, the user will preferably switch containers 71 in and out of rack 66, one by one, in order to confirm what medications need to be consumed, and how much of it, during a specific time frame. Accordingly, the user will be able to view indicia 86 and medication-related information 84 of rack 66 and continuously view the generally aligned and corresponding indicia 92 and medication-related information 90 of container 71.

FIG. 4 illustrates another alternative embodiment. The operation of rack 94 is similar to the operation of rack 10, with the exception that rack 94 accommodates only one row of containers 100, and rack 94 excludes slots 24. Container 100 is filled with medication in the same manner as container 26. Label 99 is attached to container 100 in the same manner in which label 32 is attached to container 26. However, label 99 includes both the general medication information label (containing conventional pharmacy/general medication information) and indicia 104 and medication-related information 102. Additionally, label 99 is taller that indicia 104 and medication-related information 102, in order to better accommodate the conventional pharmacy/general medication information.

Referring again to FIG. 4, indicia 108 and medication-related information 106 are similar to medication-related information 22 and indicia 23 of rack 10, except that indicia 108 and medication-related information 106 are preferably silk-screened onto rack 94 by the manufacturer of rack 94. Because there are no slots to support containers 100 during transportation of rack 94 from pharmacy to the user's home, the pharmacist, or other person, will preferably not place medication containers 100 on stand 110. Instead, the pharmacist will educate the user regarding the proper placement of containers 100 onto rack 94—as pharmacists typically educate users regarding things related to medication consumption—so that the user can undertake the task at home. Because indicia 104 and medication-related information 102 of container 100 are wider that windows 98, it will be easier for the user to align indicia 104 within windows 98. Thus, indicia 108 and medication-related information 106 of rack 94 will partially embrace indicia 104 and medication-related information 102 of container 100 when the user places (or, in other words, pegs) containers 100 onto rack 94, close to windows 98. Accordingly, the user's ability to view medication-related information 106 of rack 94 and continuously view the generally aligned and corresponding medication-related information 102 of container 100, as well as the aligned and corresponding medication-related information 102 of any additional medication containers 100 that the user may necessitate for storing additional medications, will be facilitated.

CONCLUSION, RAMIFICATIONS, AND SCOPE OF INVENTION

Thus, the reader will note that the racks and method of the present invention will facilitate, over the prior art, the user's ability to assimilate medication-related information. And because the racks of the present invention are preferably simple in structure and are preferably constructed of injection molded plastic, the cost involved in production is relatively low. Additionally, the size and manner of production of the medication racks of the present invention make them efficient and effective for distribution at any point wherein medications are distributed to users, such as a pharmacy.

While the above description contains much specificity, these should not be construed as limitations on the scope of the invention, but rather as exemplifications of one preferred embodiment and various alternative embodiments thereof. Many other variations are possible without departing from the scope of the present invention. For example, variations of the racks of the present invention (including racks 10, 66, and 94) are comprised of any combination of different sizes, materials, and shapes, provided that the racks have enough structure to accommodate at least one window of the windows of the present invention (including windows 28, 70, and 98), the indicia and medication-related information of the racks of the present invention (including indicia 23, 86, and 108; and medication-related information 22, 84, and 106), and to enable the indicia and medication-related information of the racks of the present invention to partially embrace the indicia and medication-related information (including indicia 31, 92, and 104; and medication-related information 30, 90, and 102) of the containers of the present invention (including containers 26, 71, and 100) through the employment of any of the windows of the present invention. Additional structure is further provided for some of the racks of the present invention (including racks 10, and 66) to accommodate the slots of the present invention (including slots 24, and 68), in which case at least one slot is accommodated. The racks of the present invention include any combination of the medication-related information and indicia of the present invention, which is comprised of at least two time frames which are arranged in a generally vertical format, as is visible in all FIGS.

The indicia and medication-related information of the racks of the present invention (including indicia 23, 86, and 108; and medication-related information 22, 84, and 106) and the indicia and medication-related information of the containers of the present invention (including indicia 31, 92, and 104; and medication-related information 30, 90, and 102) represent the printed matter of the current invention. The printed matter of the current invention can be accommodated anywhere along the face panels of the racks of the current invention. However, locating the printed matter on the left side of the rack, as is visible in all FIGS., is efficient, since people are used to reading from left to right.

The slots of the present invention include any structure that accommodates the containers of the present invention.

The windows of the present invention include any structure—including any width—that can accommodate viewing of the printed matter of the current invention by the user, within the intended function of the printed matter of the current invention. And although the windows of the present invention can accommodate general medication-related information, it is preferred that that the windows of the present invention be structured to only expose the indicia and medication-related information of the present invention, in order to make viewing of the printed matter of the present invention easier for the user. The windows of the present invention expose less than 50% of the circumference of the round containers of the present invention, for which a specific window of the present invention is intended for. In the case of semi-round containers, the windows of the present invention expose less than 50% of the circumference (less than 50% of the periphery) of the semi-round shape of the container. Accordingly, the printed matter of the racks of the present invention will partially embrace the printed matter of the containers of the present invention. This configuration enhances the user's ability to view horizontally the medication-related information of the racks of the present invention, and also view the generally aligned and corresponding medication-related information of the container of the present invention, as well as the generally aligned and corresponding medication-related information of any additional medication containers that are also pegged, or placed, into the racks of the present invention.

The members of the rack of the present invention—the printed matter being one member—can be structured to accommodate the members of the containers of the present invention, or the members of the containers of the present invention can be structured to accommodate the members of the rack of the present, or a combination thereof. For example, the windows of the present invention can be structured to accommodate the printed matter of the present invention, or the printed matter of the present invention can be structured to accommodate the windows of the present invention, or a combination thereof. And the leveling—or support for the leveling—of the printed matter of the present invention between the racks of the present invention and the containers of the present invention can be accomplished by either adjusting the structure of the racks and/or the printed matter of the racks of the present invention to level with the containers of the present invention, adjusting the structure of the containers of the present invention and/or the printed matter of the containers of the present invention to level with the racks of the of the present invention, or a combination thereof. However, it is preferable to make the above referenced determinations by first determining the medicinal needs of the user—or user population—then choosing an appropriately sized container. Then, structuring the container's printed matter so that it employs as much space of the container as possible, in order to make the container's printed matter more legible for the user, and then structuring the rack to accommodate the container and its members—again, the printed being one member.

The typeface of the characters that comprise the medication-related information of the present invention is preferably the pharmacy standard. The size of the characters is preferably as large as reasonably possible, in order to enhance readability, and is based on conventional typesetting standards. However, any typeface, and size which fits, can be employed.

The indicia of the present invention can be structured to include any form of graphics for the purpose of helping to guide the user to view the medication-related information of the racks and containers of the present invention, and to continuously view the generally aligned and corresponding medication-related information of at least one other container of the present invention. The indicia of the present invention may include, for example, lines, colored bands, colored space, clear space, and icons such as arrows. Wherein the indicia include colored bands, for example, as depicted in the preferred embodiment, the indicia generally align between indicia/medication-related information bearing members of the present invention, such as rack 10 and medication container 26, because the colored bands are alignable. Wherein the indicia of the racks, or of the containers, or both, are comprised of, for example, only open or blank space, the indicia is not alignable. The indicia do not have to match between indicia/medication-related information bearing members. For example, the indicia of a particular rack can include black imprinted horizontal lines, on top of clear space, separating the medication-related information of the rack, such as "MORNING" and "MID DAY", and the container intended to be slotted into said rack can exclude the black lines, employing colored bands instead. The indicia can be portrayed on various mediums, employing any reproduction method. For example, the indicia can be imprinted on any size and type of label, which then attaches to any indicia/medication-related information bearing member, such as container 26 or rack 10, or the indicia can be imprinted directly onto the indicia/medication-related information bearing member. Also, the indicia and medication-related information can be portrayed electronically. For example, a medication container, or containers, can include any of the indicia and medication-related information of the present invention encoded within an attached radio frequency identification (RFID) tag, or similar. Within this application, for example, the container with the RFID encoded medication-related information and indicia will connect electronically to, and read-out within, an LCD screen on the rack, by way of a wired medication rack. Once connected, the medication-related information and indicia will automatically level with medication-related information and indicia that appears within the rack's LCD screen. The indicia and medication-related information of the present invention can be portrayed on any type of container and rack of the present invention by a pharmacist or other person, at any point throughout the various distribution channels of medications, such as at a pharmacy.

Like the indicia of the current invention, the medication-related information of the current invention can be portrayed using various mediums and reproduction methods. The medication-related information of the present invention is comprised of at least two time frames which are arranged in a generally vertical format, as is visible in all FIGS. The medication-related information of the present invention includes any information that is useful for the purpose of supporting the consumption of medications. This information can be directly or indirectly related to the medication. Accordingly, this information can include, for example, any information relating to the medication package insert, including dosing, side effects, and contraindications. This information can also include any data regarding, for example, the prescribing doctor, such as the doctor's name and phone number, information regarding the pharmacy, or similar, and any combination thereof. The medication-related information of the present invention such as "MORNING" of rack 10 corresponds with medication-related information of the present invention such as "1" of container 26 because the user can view both continuously as "MORNING 1", which will instruct the user to take 1, in the morning, of the medication within container 26. Accordingly, the user's ability to assimilate both "MORING" and "1" as a useable message will be facilitated. In addition to the corresponding medication-related information, the indicia/medication-related information bearing members of the present invention can also include, within the general area of the corresponding medication-related information, such as within label 32 of container 26, any additional form of information that does not correspond between indicia/medication-related information bearing members. For example, container 26 of FIG. 1 can include additional information such as the name of a dispensing pharmacy, such as "JONE'S PHARMACY", above space 56, in which case label 34 of rack 10 would not include corresponding medication-related information 22, such as "PHARMACY NAME" above space 48. This, however, is not preferred because the additional information can be confusing for the user. Some of the corresponding medication-related information of the present invention generally aligns. For example, in FIG. 1 the medication-related information 22 "MORNING" of space 48 of rack 10 aligns with the medication-related information 30 "1", of space 56 of container 26. The exception involves blank spaces, such as space 58 of container 26, wherein medication-related information 30, depicted as a blank space, indicates that the medication within container 26 is not to be taken during the corresponding "NOON" period of space 50 of rack 10.

Variations of the medication containers of the present invention can comprise any container that is round or semi-round (semi-round includes oval, or any generally curve-shaped—or generally non straight-line shaped—container) made of any material, measuring any size, and containing any number of pills. Medication containers, including those of the preferred and the alternative embodiments, of the present invention can include any combination of the medication-related information and indicia of the present invention. The medication containers of the present invention can be structured to contain medicines such as inhalers, ointment tubes, drops, and any other form of medication, or combination of medications thereof. All of the racks of the present invention can be structured to accommodate any of the containers of the present invention.

Since the indicia and medication-related information (the printed matter of the current invention) can be portrayed on the containers of the present invention at any point throughout the various distribution channels of medications, by a pharmacist or other person, the user can undertake the functions of the current invention. For example, the pharmacist, or medication manufacturer, can choose to not portray the time, or quantity of medication (such as "TAKE 1") of the printed matter of the current invention, on any specific container of the present invention. Accordingly, the medication-related information of the current invention would be blank. In this case, the user may add the time, and quantity, of medication (such as "TAKE 1") by handwriting it in, or by attaching a small sticker with the medication-related information (such as "TAKE 1"), for example, to the particular space (such as space 56, if the particular medication is to be consumed in the morning). This action would be analogous to a user removing a pill from a particular medication container, with instructions to "take one pill once a day", and placing it in a pillbox, under the pillbox compartment labeled "BREAKFAST". Similarly, in the case of OTC medications, the user—or other similar person—would be more likely to be the person adding the additional medication-related information (such as "TAKE 1").

The medication time frames of the indicia/medication-related information bearing members of the present invention can be outlined within any number of periods. For example, in addition to a "MORNING" space 48, a "NOON" space 50, an "EVENING" space 52, and a "NIGHT" space 54, there are additional medication time frames that are included within the scope of the present invention, such as a "MID-MORNING" time frame. Likewise, fewer times frames can be made to comprise the indicia/medication-related information of any of the indicia/medication-related information bearing members of the present invention. Additionally, the medication time frames of the current invention are explicit. Specifically, "AM", "8 AM", "8 AM TO 9 AM", "MORNING", and "BREAKFAST" are examples of one time frame of the present invention; and "PM", "12:00 PM", "NOON", and "LUNCH" are examples of another time frame of the current invention. The opposite of said examples is, for example: "TAKE TWICE DAILY", which is not considered a time frame of the current invention. Additionally, the medication time frames of the current invention can be expressed as, for example, "TAKE 1", or a blank space or the like, as is visible in FIGS. 1, 3, and 4. For the purpose of the present invention, at least two time frames are always arranged in a generally vertical format, as is visible in all FIGS.

The reader will note that the printed matter of co-pending application Ser. No. 11/426,002, filed on Jun. 22, 2006, entitled APPARATUS AND METHOD FOR FACILITATING MEDICATION-RELATED INFORMATION is fully incorporated in all of the racks and containers of the current invention.

Accordingly, the scope of the invention should be determined not by the embodiments noted, but by the appended claims and their legal equivalents.

What is claimed is:

1. A rack for holding at least one substantially cylindrical medication container, said container including at least two substantially horizontally extending indicia and at least one medication-related information quantity, the rack comprising:

a body having a substantially planar bottom panel having an upper surface and a lower surface for resting on a support surface, said bottom panel substantially perpendicular to a substantially planar front panel having a front surface, the front panel further including at least one window opening, the window opening located between two wall surfaces defined by the front panel, and extending substantially upward from the bottom panel and through a top of the front panel, at least one of the two wall surfaces including at least two substantially horizontally extending indicia and at least two time frames, said two indicia located above one another in a substantially vertical direction on the front surface of the front panel between the top and bottom thereof, said two time frames located within said indicia, the at least one window opening adapted to expose less than 50% of the circumference of the at least one medication container, whereby the at least one medication container is adapted to be placed onto the upper surface of the bottom panel of the rack, substantially adjacent to the at least one window opening, such that the at least one medication-related information quantity on the container is adapted to be viewed through the at least one window opening, the at least one medication-related information quantity on the container is adapted to lie substantially aligned with one of the at least two time frames on the rack, and the medication-related information quantity on the container is adapted to correspond with one of the at least two time frames on the rack.

2. The rack of claim 1, said at least one window opening further comprising a plurality of window openings.

3. The rack of claim 1, said at least two time frames including at least one word, abbreviation, or number denoting a time or time range.

4. The rack of claim 1, said body being fabricated from molded plastic.

5. The rack of claim 1, said indicia included on at least one of the two wall surfaces including at least two colored bands located above one another in a substantially vertical direction on the front surface of the front panel between the top and bottom thereof.

6. The rack of claim 1, further including at least one medication container.

7. The rack of claim 1, said at least two substantially horizontally extending indicia further extending substantially horizontally on the two wall surfaces defined by the front surface and terminating at a second window opening.

8. The rack of claim 1, said indicia and time frames comprised of printed labels that are attached to at least one of said two wall surfaces.

9. The rack of claim 1, said indicia and time frames printed on at least one of said two wall surfaces.

10. A rack for holding at least one substantially cylindrical medication container, said container including at least two substantially horizontally extending indicia and at least one medication-related information quantity, the rack comprising:

a body having a substantially planar top surface parallel to a substantially planar bottom surface for resting on a support surface, at least one substantially cylindrical slot opening extending through the top surface and extending through the body and terminating at an angled lower surface located above the bottom surface of the body, the body further comprising a front surface, disposed at an angle relative to the bottom surface, and a back surface; the slot opening further extending through the body from the front surface to a location between the front surface and the back surface, to define a window, extending from the top surface to a location above the bottom surface, the window located in between two wall surfaces defined by the front surface, at least one of the two wall surfaces having a surface including at least two substantially horizontally extending indicia and at least two time frames, said two time frames located above one another in a substantially vertical direction on the front surface of the front panel between the top and bottom thereof, the at least one widow opening adapted to expose less than 50% of the circumference of the at least one medication container, whereby the at least one medication container is adapted to be placed into the slot opening in the body, through the top surface and resting on the angled lower surface, thereby disposing the medication container at angle with a top of the medication container located above the top surface of the body, such that the at least one medication-related information quantity on the container can be viewed through the window, the at least one medication-related information quantity on the container lies substantially aligned with one of the time frames on the rack, and the at least one medication-related information quantity on the container corresponds with one of the time frames on the rack.

11. The rack of claim 10, whereby the at least one slot opening comprises a plurality of slot openings, each having a window.

12. The rack of claim 10, said time frames including at least one word, abbreviation, or number denoting a time or time range.

13. The rack of claim 10, said body being fabricated from molded plastic.

14. The rack of claim 10, said indicia included in at least one of the two wall surfaces including at least two colored bands located above one another in a substantially vertical direction on the front surface of the front panel between the top and bottom thereof.

15. The rack of claim 10, further including at least one medication container.

16. The rack of claim 10, whereby at least one slot opening and window is disposed in the back surface.

17. The rack of claim 10, further including a substantially arch shaped lip wall extending from the edges of the two wall surfaces, said edges adjacent the window, and across the window opening, further extending from the bottom surface, and extending substantially upwards from the bottom surface.

18. The rack of claim 10, said at least two substantially horizontally extending indicia further extending substantially horizontally on the two wall surfaces defined by the front surface and terminating at a second window.

19. The rack of claim 10, said indicia included in at least one of the two wall surfaces and time frames comprised of printed labels that are attached to said at least one wall surface.

20. The rack of claim 10, said indicia and time frames printed on said at least one wall surface.

* * * * *